United States Patent [19]

Wright

[11] Patent Number: 5,025,839

[45] Date of Patent: Jun. 25, 1991

[54] TWO-PLY PAPERMAKERS FORMING FABRIC WITH ZIG-ZAGGING MD YARNS

[75] Inventor: Walter P. Wright, Larsen, Wis.

[73] Assignee: Asten Group, Inc., Charleston, S.C.

[21] Appl. No.: 501,237

[22] Filed: Mar. 29, 1990

[51] Int. Cl.[5] ..... D03D 11/00

[52] U.S. Cl. ..... 139/383 A

[58] Field of Search ..... 139/383 A, 425 A

[56] References Cited

U.S. PATENT DOCUMENTS

| | | | |
|---|---|---|---|
| 4,171,009 | 10/1979 | Karm . | |
| 4,314,589 | 2/1982 | Buchanan et al. . | |
| 4,361,618 | 11/1982 | Dufour et al. . | |
| 4,499,927 | 2/1985 | Borel . | |
| 4,501,303 | 2/1985 | Osterberg | 139/425 A |
| 4,518,644 | 5/1985 | Vuorio | 139/383 A X |
| 4,554,953 | 11/1985 | Borel et al. | 139/425 A X |
| 4,564,051 | 1/1986 | Odenthal | 139/425 A |
| 4,564,052 | 1/1986 | Borel . | |
| 4,569,375 | 2/1986 | Borel . | |
| 4,592,395 | 6/1986 | Borel . | |
| 4,709,732 | 12/1987 | Kinnunen . | |
| 4,776,373 | 10/1988 | Borel . | |
| 4,867,206 | 9/1989 | Kufferath . | |
| 4,945,952 | 8/1990 | Vohringer | 139/425 A X |
| 4,967,805 | 11/1990 | Chiu et al. | 139/383 A |

*Primary Examiner*—Andrew M. Falik
*Attorney, Agent, or Firm*—Volpe and Koenig

[57] ABSTRACT

A two-ply forming fabric having an upper paper carrying/forming layer which comprises twice as many cross machine direction yarns as the lower, machine-side layer. A system of machine direction yarns interweaves in a selected repeat pattern such that a zigzag effect is produced on the underside of the fabric by the machine direction yarns to provide improved drainage. The higher count of upper layer CMD yarns selectively interwoven in a non-twill pattern with 80%-100% cover of MD yarns provides an improved paper forming/carrying surface.

18 Claims, 2 Drawing Sheets

TWO-PLY PAPERMAKERS FORMING FABRIC WITH ZIG-ZAGGING MD YARNS

The present invention relates to papermakers fabrics and, in particular, fabrics intended to facilitate the initial formation of an aqueous paper web in the manufacture of paper.

BACKGROUND OF THE INVENTION

Papermaking machines generally are comprised of three sections: forming, press, and drying. Papermakers fabrics are employed to transport a continuous paper sheet through the papermaking equipment as it is being manufactured. The requirements and desirable characteristics of papermakers fabrics vary in accordance with the particular section of the machine where the respective fabrics are utilized.

In particular, in the forming section of papermaking equipment, forming fabrics are utilized to initially create an aqueous paper sheet or web from a pulp slurry. Typically, the pulp slurry is deposited on the moving forming fabric which transports the slurry over suction boxes or other means to form the paper web. The surface characteristics and drainage characteristics of the forming fabric play an important role in the initial formation of the aqueous paper web.

Multi-layer forming fabrics are known in the art. For example, U.S. Pat. No. 4,709,732 discloses a dual layer forming fabric for use in the papermaking process.

SUMMARY AND OBJECTS OF THE INVENTION

A two-ply forming fabric is provided having an upper paper carrying/forming layer which comprises twice as many cross machine direction yarns as the lower, machine-side layer. A system of machine direction yarns interweaves in a selected repeat pattern such that a zigzag effect is produced on the underside of the fabric by the machine direction yarns to provide improved drainage. The higher count of upper layer CMD yarns selectively interwoven in a non-twill pattern with 80%-100% cover of MD yarns provides an improved paper forming/carrying surface.

Other objects and advantages of the present invention will become apparent from the following description of a presently preferred embodiment.

A BRIEF DESCRIPTION OF THE DRAWINGS

FIG. 1 is a plan view of the machine-side or bottom of a papermakers fabric made in accordance with the teaching of the present invention; and FIG. 2 is a set of schematic diagrams depicting the weave pattern of each of eight machine direction yarns of a repeat interweaving with the cross machine direction yarn layers of the fabric shown in FIG. 1.

DETAILED DESCRIPTION OF A PRESENTLY PREFERRED EMBODIMENT

Figure 1:
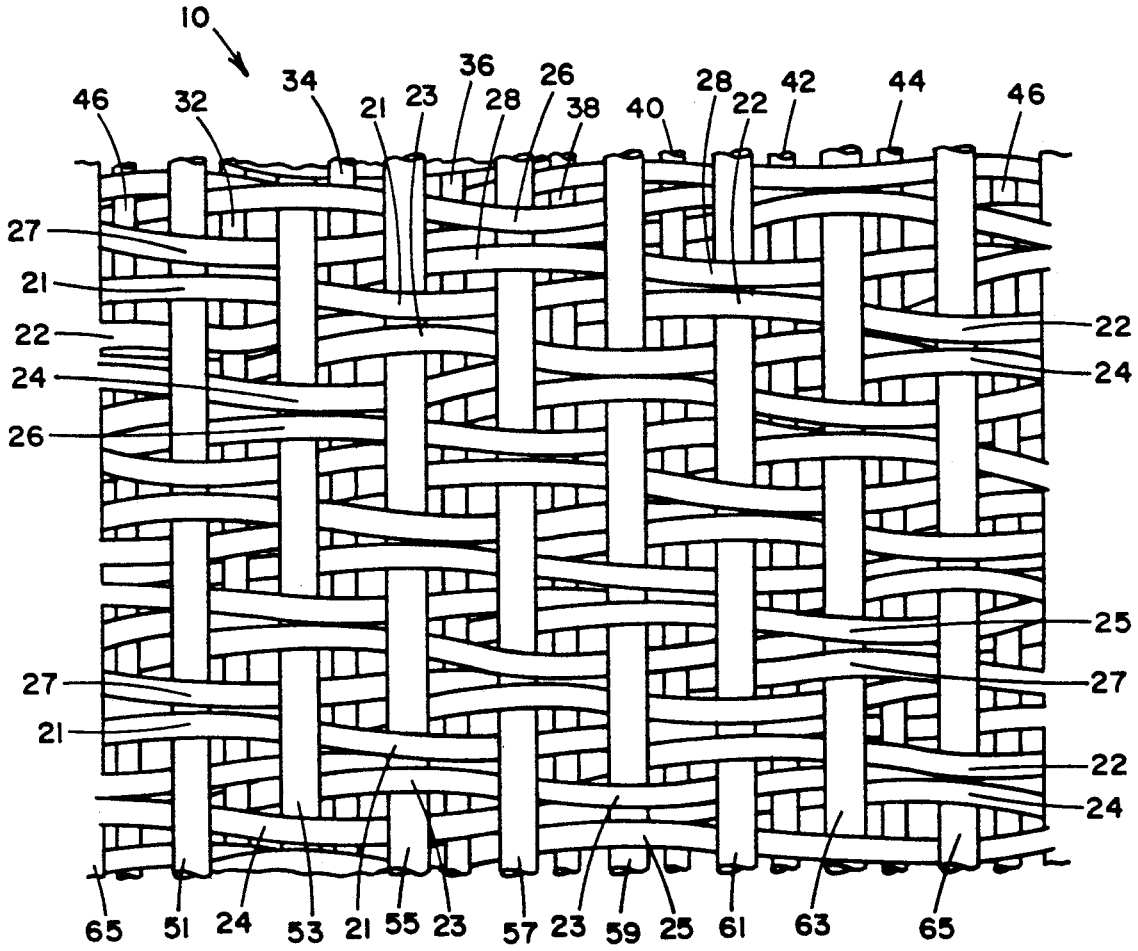
Figure 2:
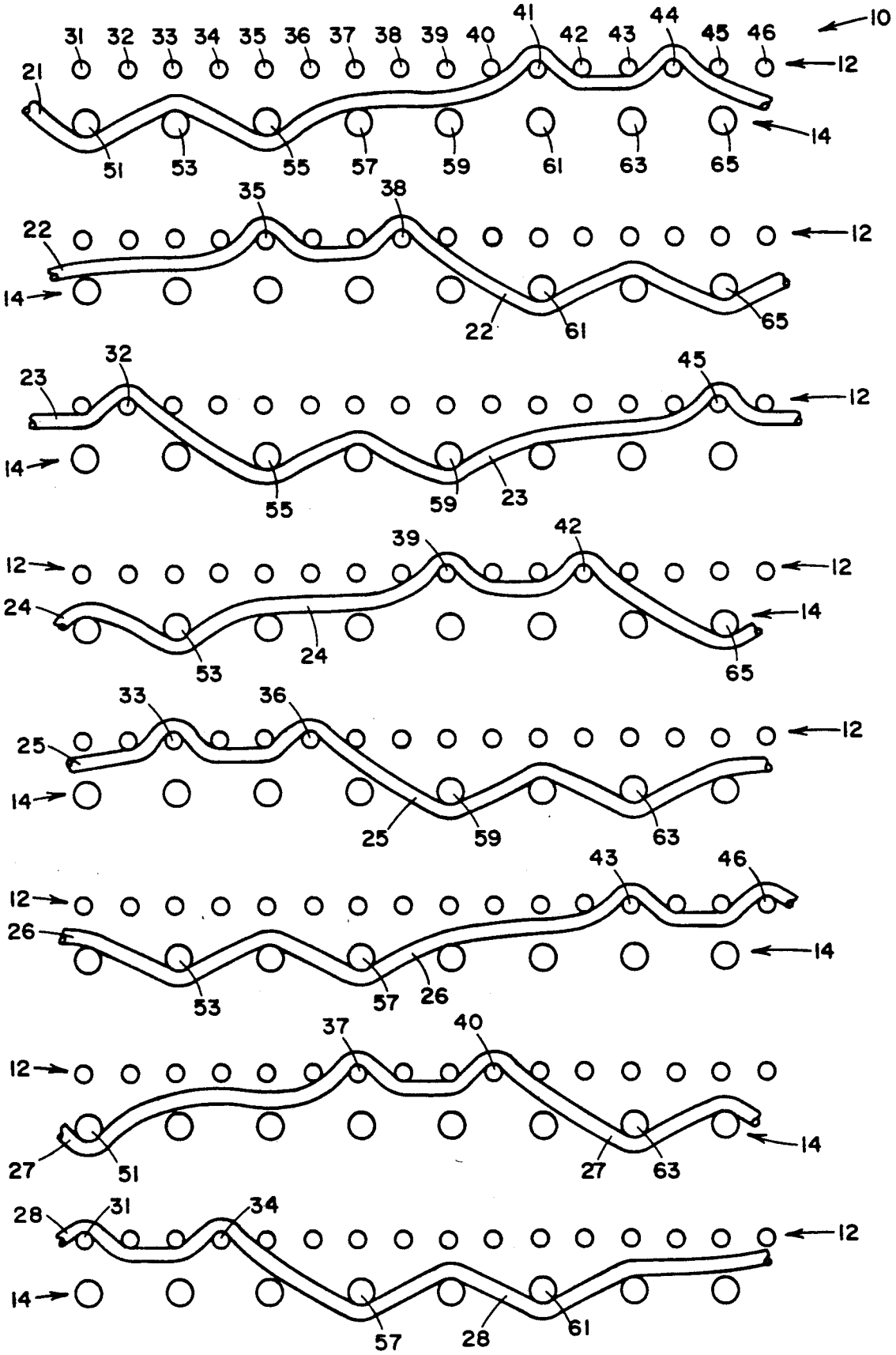

Referring to FIGS. 1 and 2, there is shown a fabric 10 comprising a top layer 12 of cross machine direction (CMD) yarns 31–46 and a bottom layer 14 of cross machine direction (CMD) yarns 51–65. The top and bottom CMD layers 12, 14 are interwoven with a system of machine direction (MD) yarns 21–28 in a repeat pattern, as shown.

As will be recognized by those skilled in the art, reference to cross machine direction and machine direction is made with respect to the orientation of the fabric on a papermaking machine. Machine direction is the direction that the fabric travels when installed and used on the papermaking equipment; cross machine direction is perpendicular thereto.

Typically, a fabric may be woven flat so that the MD yarns are strung as warp on the loom. Where the fabric is woven flat, the fabric ends would be seamed together to form an endless belt when the fabric is installed on a papermaking equipment. However, the fabric could be woven endless. In endless weaving, the cross machine direction yarns would normally be the warp. A variety of weaving and seaming techniques are well known in the art including the endless weaving of seamed fabrics.

The papermakers fabric of the present invention is preferably woven with twice as many yarns in the upper CMD layer 12 than in the lower CMD layer 14. The repeat pattern of eight MD yarns interweaves with sixteen upper layer CMD yarns and eight of the larger lower layer CMD yarns per repeat.

With reference to FIG. 2, the detailed weaving of each MD yarn of the repeat is shown. For example, MD yarn 21 weaves under upper CMD yarns 31, 32 and lower CMD yarn 51, between upper CMD yarn 33 and lower CMD yarn 53, under upper CMD yarns 34, 35, 36 and lower CMD yarn 55, between upper CMD yarns 37, 38, 39, 40 and lower CMD yarns 57, 59, over upper CMD yarn 41 and lower CMD 61, under upper CMD yarn 42, between upper CMD yarn 43 and lower CMD 63, over upper CMD yarn 44, between upper CMD yarn 45 and lower CMD yarn 65, and under upper CMD yarn 46 thereafter repeating. Essentially, each MD yarn weaves between top layer 12 CMD yarns 31–46 and bottom layer 14 CMD yarns 51–65, with each MD yarn weaving over only two individual, separate top layer CMD yarns and under two individual, separate bottom layer CMD yarns:

MD yarn 21 weaving over top layer CMD yarns 41, 44, under bottom CMD yarns 51, 55, and between the other top layer and bottom layer yarns, respectively;

MD yarn 22 weaving over top layer CMD yarns 35, 38, under bottom CMD yarns 61, 65, and between the other top layer and bottom layer yarns, respectively; and MD yarn 23 weaving over top layer CMD yarns 45, 32, under bottom CMD yarns 55, 59, and between the other top layer and bottom layer yarns, respectively;

MD yarn 24 weaving over top layer CMD yarns 39, 42, under bottom CMD yarns 65, 53, and between the other top layer and bottom layer yarns, respectively;

MD yarn 25 weaving over top layer CMD yarns 33, 36, under bottom CMD yarns 59, 63, and between the other top layer and bottom layer yarns, respectively;

MD yarn 26 weaving over top layer CMD yarns 43, 46, under bottom CMD yarns 53, 57, and between the other top layer and bottom layer yarns, respectively;

MD yarn 27 weaving over top layer CMD yarns 37, 40, under bottom CMD yarns 63, 51, and between the other top layer and bottom layer yarns, respectively;

MD yarn 28 weaving over top layer CMD yarns 31, 34, under bottom CMD yarns 57, 61, and between the other top layer and bottom layer yarns, respectively.

The interweaving of the MD yarn system with the upper layer CMD yarns creates knuckles on the top surface of the fabric where the MD yarns weave over the selected top layer CMD yarns. It is preferred that the MD yarns which define the knuckles with respect to the top fabric layer are separated by two upper layer CMD yarns as shown. The resultant weave pattern defines a staggered or non-twill repeat on the upper fabric surface.

As best seen in FIG. 1, the differential size and spacing of the CMD yarn layers combined with the selected weave pattern of the MD yarn system causes the MD yarns to create a zigzag pattern along the bottom layer of the fabric. For example, MD yarns 21 and 23 both weave under lower layer yarn 55 while intermediate yarn 22 is weaving over upper layer yarn 35. As a result MD yarns 21 and 23 gravitate toward each other directly underneath MD yarn 22.

Similarly, throughout the repeat pattern alternate MD yarns weave under a common lower CMD yarn while the intermediate MD yarn weaves over an upper CMD yarn. Thus, MD yarns 22, 24 weave under lower CMD yarn 65 while intermediate MD yarn 23 weaves over upper CMD yarn 45; MD yarns 23, 25 weave under lower CMD yarn 59 while intermediate MD yarn 24 weaves over upper CMD yarn 39; and so forth.

For each lower CMD yarn, there is a spaced pair of MD yarns which weave under that lower layer of yarn while an intermediate MD yarn weaves over an upper layer yarn which results in the spaced MD layer yarn pair being displaced towards each other. This produces zigzagging of the MD yarns within the bottom layer of the fabric and promotes drainage to facilitate the fabric's function. Furthermore, on the top surface of the fabric, the knuckles defined by the MD yarns define a uniform paper forming/carrying surface.

The MD yarns are preferably polyester monofilament 0.0045 inches in diameter. Preferably the top layer CMD yarns are also polyester monofilament yarns having a diameter of 0.0045 inches. In contrast, the bottom layer CMD yarns are significantly larger, being monofilament polyester yarns having a diameter of 0.0070 inches.

Although specific size yarns have been disclosed, the diameter of the MD yarns may range from 0.0032 to 0.0250 inches, the diameter of the upper CMD yarns from 0.0032 to 0.0300 inches, and the diameter of the lower CMD yarns from 0.0035–0.0450 inches. Preferably the top layer CMD yarns are in the range of 50%–90% of the diameter of the larger bottom layer CMD yarns.

Although polyester and/or polyamide yarns are preferred, it will be recognized by those of ordinary skill in the art that other types of yarns may be employed where the demands of the specific application make other materials preferable.

After weaving, the fabric is heat set in a conventional manner to finish the fabric. Preferably, the fabric is woven to finish with 200 MD yarns per inch and 150 CMD yarns per inch. Where the yarn size is varied (in accordance with the ranges set forth above), the yarn count per inch will correspondingly vary resulting in the MD yarn system being woven to finish from 40 yarns per inch to 250 yarns per inch. It is preferred that the MD cover provided by the yarns is between 80% and 100%. MD cover is the percentage of the space occupied by the MD yarns across the width of the fabric. For example, with the preferred yarn size of 0.0045 inches woven 200 MD yarns per inch, the MD cover is 90%, i.e. 0.900 inches width of yarn per inch of fabric width.

The CMD yarns are preferably woven to finish in the range of 75 yarns per inch to 195 yarns per inch comprising twice as many upper CMD yarns than lower CMD yarns. This results in the lower CMD yarns being woven to finish from 25 to 65 yarns per inch.

Other variations within the scope and spirit of the invention will be apparent to those of ordinary skill in the art.

What is claimed is:

1. A papermakers forming fabric comprising:

a lower CMD yarn layer having a selected number of yarns per inch;

an upper CMD yarn layer having twice said selected number of yarns per inch;

said upper layer CMD yarns being of a smaller diameter than said lower layer CMD yarns; and a system of MD yarns interwoven with said CMD yarn layers in a repeat pattern such that:

(a) each MD yarn interweaves under at least a first individual lower layer CMD yarns, and (b) the order of the repeat of the MD yarns is staggered such that alternate MD yarns are paired and weave under a common individual lower layer CMD yarn whereby the MD yarns zigzag on the underside of said fabric.

2. The fabric of claim 1 wherein the selected number of CMD yarns per inch is in the range of 25–65 yarns, the diameter of the lower CMD yarns is in the range of 0.0035–0.0450 inches, and the diameter of the upper CMD yarns is in the range of 0.0032–0.0300 inches such that the upper CMD yarn diameter is in the range of 50–90% of the lower CMD yarn diameter.

3. The fabric of claim 1 wherein said repeat pattern comprises eight lower layer CMD yarns and sixteen upper layer CMD yarns interwoven with a system of eight MD yarns.

4. The fabric of claim 3 wherein each respective MD yarn interweaves:

(a) with respect to said lower CMD layer, under only first and second individual non-adjacent lower CMD yarns, and (b) with respect to said upper CMD layer, over only first and second individual non-adjacent CMD layer yarns.

5. The fabric of claim 4 wherein said respective first and second lower CMD yarns interwoven with each respective MD yarn are separated by one intermediate lower CMD yarn and wherein said respective first and second upper CMD yarns interwoven with each respective MD yarn are separated by two intermediate upper CMD yarns.

6. The fabric of claim 5 wherein with respect to each respective MD yarn of said repeat, said first, second and one intermediate lower layer yarns are not directly under said first, second or two intermediate upper CMD yarns.

7. The fabric of claim 1 wherein an intermediate MD yarn between each paired MD yarns weaves over an upper CMD yarn directly above the lower CMD yarn under which the paired MD yarns commonly weave.

8. The fabric of claim 7 wherein the yarns are polyester monofilament yarns, the selected number of CMD yarns per inch is 50 yarns, the diameter of the lower CMD yarns is 0.0070 inches, the diameter of the upper CMD yarns is 0.0045 inches, the diameter of the MD yarns is 0.0045 inches and the MD yarns are 200 yarns per inch.

9. The fabric of claim 1 wherein the diameter of the MD yarns is in the range of 0.0032–0.0250 inches, and the MD yarns are in the range of 40–250 yarns per inch such that the MD cover is in the range of 80–100%.

10. A papermakers forming fabric comprising:
a lower CMD yarn layer having a selected number of yarns per inch;
an upper CMD yarn layer having twice said selected number of yarns per inch;
said upper layer CMD yarns being of a smaller diameter than said lower layer CMD yarns;
a system of MD yarns interwoven with said CMD yarn layers in a repeat pattern with each MD yarn interwoven:
(a) with respect to said lower CMD layer, under only first and second individual non-adjacent lower CMD yarns, and
(b) with respect to said upper CMD layer, over only first and second individual non-adjacent CMD layer yarns; and
the order of the repeat of the MD yarns is staggered such that alternate MD yarns are paired and weave under a common individual lower layer CMD yarn and an intermediate MD yarn between each paired MD yarn weaves over an upper CMD yarn directly above the lower CMD yarn under which the paired MD yarns commonly weave, whereby the MD yarns zigzag on the underside of said fabric.

11. A papermakers forming fabric comprising:
a lower CMD yarn layer having a selected number of yarns per inch;
an upper CMD yarn layer having twice said selected number of yarns per inch;
said upper layer CMD yarns being of a smaller diameter than said lower layer CMD yarns; and
a system of MD yarns interwoven with said CMD yarn layers in a repeat pattern with each MD yarn interwoven:
(a) with respect to said lower CMD layer, under only first and second individual non-adjacent lower layer CMD yarns which are separated by only one intermediate lower layer CMD yarn, and
(b) with respect to said upper CMD layer, over only first and second individual non-adjacent CMD upper layer yarns which are separated by two intermediate upper layer CMD yarns.

12. The fabric of claim 11 wherein the selected number of CMD yarns per inch is in the range of 25–65 yarns per inch, the diameter of the lower CMD yarns is in the range of 0.0035–0.0450 inches, and the diameter of the upper CMD yarns is in the range of 0.0032–0.0300 inches such that the upper CMD yarn diameter is in the range of 50–90% of the lower CMD yarn diameter.

13. The fabric of claim 11 wherein said repeat pattern comprises eight lower layer CMD yarns and sixteen upper layer CMD yarns interwoven with a system of eight MD yarns.

14. The fabric of claim 11 wherein with respect to each respective MD yarn of said repeat, said first, second and one intermediate lower layer yarns are not directly under said first, second or two intermediate upper CMD yarns.

15. The fabric of claim 14 wherein the order of the repeat of the MD yarns is staggered such that alternate MD yarns are paired and weave under a common lower layer CMD yarn whereby the MD yarns zigzag on the underside of said fabric.

16. The fabric of claim 15 wherein an intermediate MD yarn between each paired MD yarns weaves over an upper CMD yarn directly above the lower CMD yarn under which the paired MD yarns commonly weave.

17. The fabric of claim 16 wherein the yarns are polyester monofilament yarns, the selected number of CMD yarns per inch is 50 yarns per inch, the diameter of the lower CMD yarns is 0.0070 inches, the diameter of the upper CMD yarn is 0.0045 inches, the diameter of the MD yarns is 0.0045 inches and the MD yarns are 200 yarns per inch.

18. The fabric of claim 11 wherein the diameter of the MD yarns is in the range of 0.0032–0.0250 inches, and the MD yarns are in the range of 40–250 yarns per inch such that the MD cover is in the range of 80–100%.

* * * * *